United States Patent [19]

Nagasaka et al.

[11] 4,232,689

[45] Nov. 11, 1980

[54] COIN DISPENSER

[75] Inventors: Takakazu Nagasaka, Nara; Yasuhide Nakamura, Yamatokoriyama, both of Japan

[73] Assignee: Sharp Kabushiki Kaisha, Osaka, Japan

[21] Appl. No.: 957,104

[22] Filed: Nov. 2, 1978

[30] Foreign Application Priority Data

Nov. 5, 1977 [JP] Japan ..... 52-150065

[51] Int. Cl.[3] ..... G07D 1/00; B65H 3/44

[52] U.S. Cl. ..... 133/4 A; 133/2; 221/129

[58] Field of Search ..... 133/2, 4 R, 4 A, 5 R; 194/1 L-1 N, DIG. 26; 221/112, 129; 361/167, 169; 307/41

[56] References Cited

U.S. PATENT DOCUMENTS

| | | | |
|---|---|---|---|
| 3,167,078 | 1/1965 | Trautenberg | 133/4 R |
| 3,690,332 | 9/1972 | Dykehouse et al. | 133/2 |
| 3,831,806 | 8/1974 | Lindsey | 221/129 X |
| 3,934,692 | 1/1976 | Novak et al. | 133/5 R X |

*Primary Examiner*—Robert J. Spar
*Assistant Examiner*—Edward M. Wacyra
*Attorney, Agent, or Firm*—Birch, Stewart, Kolasch & Birch

[57] ABSTRACT

A coin dispenser is disclosed which includes a plurality of containers at least two of which contain coins of a same kind. A pattern generator develops container selection signals in accordance with coin dispensation amount information applied thereto. A control system is connected to receive the container selection signals and functions to select one of the at least two containers containing the same kind of coins alternatingly or sequentially, thereby uniformly dispensing coins from the at least two containers.

7 Claims, 2 Drawing Figures

COIN DISPENSER

BACKGROUND AND SUMMARY OF THE INVENTION

The present invention relates to a coin dispenser for dispensing desired amount of coins in accordance with selection pattern information applied from a control system.

Generally, a coin dispenser comprises a plurality of containers for storing coins, each container containing a predetermined kind of coins. Some containers, for example two containers, contain the same kind of coins which are the most frequently selected coins. This type of coin dispenser further comprises a selection pattern generator for selecting desired containers to dispense desired amount of money in accordance with dispense amount information applied to the selection pattern generator.

The two containers containing the same kind of coins must be selected at a same frequency, or the coins contained in the two containers must be dispensed at the same rate in order to stabilize the operation of the coin dispenser. In the conventional coin dispenser, there is a possibility that coins contained in one container are all dispensed although another container contains some amount of coins of the same kind as stored in the one container. Under these conditions, the coin dispenser erroneously operates or can not operate.

The above-mentioned unbalanced delivery is caused by the conventional system, wherein the selection pattern generator develops a predetermined selection signal in response to the dispense amount information, and the container selection is controlled by the selection signal derived from the selection pattern generator without regard to the preceding selection operation.

Accordingly, an object of the present invention is to provide a coin dispenser of stable operation.

Another object of the present invention is to provide a coin dispenser which includes a plurality of containers for containing the same kind of coins, and wherein the plurality of containers dispense the coins of the same kind at a same rate.

Still another object of the present invention is to provide a control system for a coin dispenser, which controls the coin dispensation taking account of the preceding dispensation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a selection pattern generator is provided for developing a selection signal in response to dispense amount information applied thereto. A plurality of containers contain the same kind of coins. A selection switching means is interposed between the selection pattern generator and a driver means connected to the containers so that the containers containing the same kind of coins are sequentially selected.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
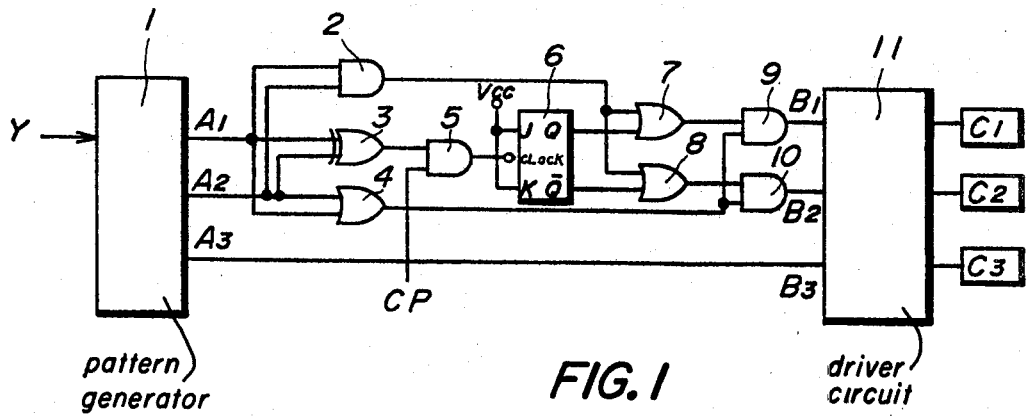
FIG. 1 is a block diagram of an embodiment of a coin dispenser of the present invention.

The coin dispenser of the present invention mainly comprises a pattern generator 1 for developing selection pattern signals from output terminals $A_1$, $A_2$ and $A_3$ in accordance with coin dispensation amount information Y applied thereto. The pattern generator 1 generally comprises a read only memory (ROM), and the selection pattern signals derived from the output terminals $A_1$, $A_2$ and $A_3$ are used to select desired containers having stored coins for dispensing desired amount of coins corresponding to the coin dispensation amount information Y.

The coin dispenser further comprises an AND gate 2 connected to receive the signals derived from the output terminals $A_1$ and $A_2$ of the pattern generator 1, an exclusive-OR gate 3 connected to receive the signals derived from the output terminals $A_1$ and $A_2$ of the pattern generator 1, and an OR gate 4 connected to receive the signals derived from the output terminals $A_1$ and $A_2$ of the pattern generator 1. An output signal of the exclusive-OR gate 3 is applied to one input terminal of an AND gate 5, and the other input terminal of the AND gate 5 receives a clock pulse CP. An output signal of the AND gate 5 is applied to a JK filp-flop 6.

An OR gate 7 is connected to receive an output signal of the AND gate 2 and an output signal from the Q output terminal of the JK flip-flop 6. Another OR gate 8 is connected to receive the output signal of the AND gate 2 and an output signal from the $\overline{Q}$ output terminal of the JK flip-flop 6. Output signals of the OR gates 4 and 7 are applied to an AND gate 9, and output signals of the OR gates 4 and 8 are applied to an AND gate 10.

The coin dispenser further includes a driver circuit 11 for selecting desired containers $C_1$, $C_2$ and $C_3$ in response to signals applied to input terminals $B_1$, $B_2$ and $B_3$. The input terminal $B_1$ receives an output signal derived from the AND gate 9, the input terminal $B_2$ receives an output signal of the AND gate 10, and the input terminaL $B_3$ receives a signal derived from the output terminal $A_3$ of the pattern generator 1. The containers $C_1$ and $C_2$ store the coins of the same kind. The driver circuit 11 can be a conventional driver circuit including an electro-magnetic actuator for dispensing coins from the containers $C_1$, $C_2$ and $C_3$ in response to the signals applied to the input terminals $B_1$, $B_2$ and $B_3$.

Operation of the coin dispenser of FIG. 1 will be described with reference to FIG. 2.

Now assume that the output terminals $A_1$ and $A_2$ of the pattern generator 1 develop the signals of logic high in response to the coin dispensation amount information Y applied thereto. The AND gate 2 is turned on to develop a signal of logic high. The OR gate 4 also develops a signal of logic high and, therefore, the AND gates 9 and 10 are turned on to apply signals of logic high to the input terminals $B_1$ and $B_2$ of the driver circuit 11. Accordingly, the containers $C_1$ and $C_2$ are driven to dispense the coins.

When the output terminals $A_1$ and $A_2$ of the pattern generator 1 develop the signals of logic low, the AND gates 9 and 10 are not turned on and, therefore, the containers $C_1$ and $C_2$ are not selected.

The container $C_3$ is selected when the signal of logic high is developed from the output terminal $A_3$ of the pattern generator 1.

Now assume that the output terminal $A_1$ develops the signal of logic high, and the output terminal $A_2$ develops the signal of logic low, or the output terminal $A_1$ develops the signal of logic low and the output terminal $A_2$ develops the signal of logic high. The exclusive-OR gate 3 is turned on to apply the signal of logic high to the following AND gate 5. Therefore, the AND gate 5 develops a one-shot pulse in response to the clock pulse CP. The thus obtained one-shot pulse is applied to the clock terminal of the J-K flip-flop 6. Since the J input terminal and the K input terminal of the JK flip-flop 6 are connected to receive a signal of logic high, the Q output terminal and the $\overline{Q}$ output terminal alternatingly develop the signal of logic high in response to the occurrence of the one-shot pulse.

The Q and $\overline{Q}$ outputs are applied to the AND gates 9 and 10 through the OR gates 7 and 8, respectively. Therefore, the AND gates 9 and 10 develop the signal of logic high in an alternating fashion when only one of the output terminals $A_1$ and $A_2$ develops the signal of logic high.

More specifically, when the output terminal $A_1$ develops the signal of logic high and the output terminal $A_2$ develops the signal of logic low three times, the container $C_1$ is selected at the first time, the container $C_2$ is selected at the second time, and the container $C_1$ is selected at the third time. In this way, the coins of the same kind stored in the containers $C_1$ and $C_2$ are dispensed at a same rate.

Figure 2:
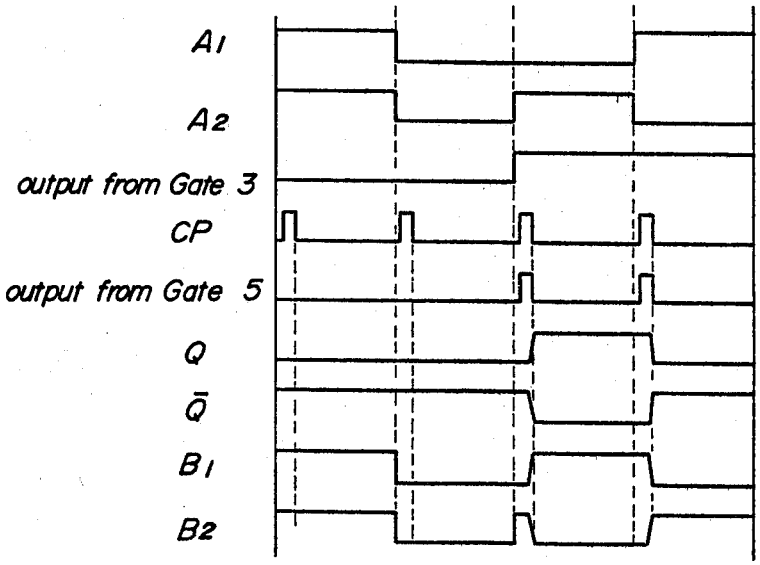
FIG. 2 is a time chart showing waveforms of signals occurring within the coin dispenser of FIG. 1.

The number of containers is not limited to the embodiment of FIG. 1.

The invention being thus described, it will be obvious that the same may be varied in many ways. Such variations are not to be regarded as a departure from the spirit and scope of the invention, and all such modifications are intended to be included witin the scope of the following claims.

What is claimed is:

1. A control system for a coin dispenser including a plurality of containers, at least two of said containers containing coins of a same kind; a pattern generator for developing container selection signals in response to a coin dispensation amount signal applied thereto; and a drive means for selecting desired containers in accordance with the container selection signals derived from said pattern generator, said control system comprising:

digital logic switching means operatively connected between said pattern generator and said drive means for sequentially selecting one of said at least two containers in response to said container selection signals derived from said pattern generator, said logic switching means uniformly dispensing said coins of the same kind from said at least two containers.

2. A control system for a coin dispenser including a plurality of containers, at least two of said containers containing coins of a same kind; a pattern generator for developing container selection signals in response to a coin dispensation amount signal applied thereto; and a drive means for selecting desired containers in accordance with the container selection signals derived from said pattern generator, said control system comprising:

priority determination means operatively connected between said pattern generator and said drive means for shifting the priority of selection sequentially between said at least two containers, said priority determination means uniformly dispensing said coins of the same kind from said at least two containers, said priority determination means allowing said drive means to simultaneously dispense two coins of the same kind.

3. A control system for a coin dispenser including a plurality of containers, at least two of said containers containing coins of a same kind; a pattern generator for developing container selection signals in response to a coin dispensation amount signal applied thereto; and a drive means for selecting desired containers in accordance with the container selection signals derived from said pattern generator, said control system comprising:

digital priority determination means for shifting the priority of selection sequentially between said at least two containers, said digital priority determination means uniformly dispensing said coins of the same kind from said at least two containers.

4. The control system of claim 3, wherein said priority determination means is operatively connected between said pattern generator and said drive means.

5. The control system of claim 3, 4, or 2 wherein said priority determination means comprise a storage means for storing information related to the preceding selection of said at least two containers, said storage means functioning to apply priority to said container of said at least two containers which was not previously selected.

6. The control system of claim 5, wherein said storage means comprises a JK flip-flop.

7. The control system of claim 3, wherein said at least two containers consists of two containers, and said priority determination means functions to alternatingly select each of said two containers in response to the container selection signal derived from said pattern generator.

* * * * *